US005102321A

United States Patent [19]

Murata et al.

[11] Patent Number: 5,102,321

[45] Date of Patent: Apr. 7, 1992

[54] POROUS LAYER FOR A PRESSURE CASTING MOLD

[75] Inventors: Kazushige Murata; Takeshi Ito, both of Tokoname, Japan

[73] Assignee: Inax Corporation, Tokoname, Japan

[21] Appl. No.: 704,185

[22] Filed: May 22, 1991

[30] Foreign Application Priority Data

Jun. 28, 1990 [JP] Japan ..... 2-172299

[51] Int. Cl.[5] ..... B28B 7/00

[52] U.S. Cl. ..... 425/84; 249/141; 425/85

[58] Field of Search ..... 249/134, 141; 264/86, 264/87, 337; 425/84, 85

[56] References Cited

U.S. PATENT DOCUMENTS 4,552,329 11/1985 Hattori et al. ..... 425/84
4,810,442 3/1989 Hillig et al. ..... 264/87
4,814,127 3/1989 Toyoda ..... 264/87
4,840,763 6/1989 Freitag ..... 264/87
5,000,896 3/1991 Petrovic et al. ..... 264/86

FOREIGN PATENT DOCUMENTS 58-208005 12/1983 Japan .

*Primary Examiner*—Jay H. Woo
*Assistant Examiner*—C. Scott Bushey

[57] ABSTRACT

A pressure casting mold used to mold sanitary earthenware, including a porous layer composed mainly of resin material, a filler, a curing agent and water, the filler being formed of fibers and particulates of glass material, an average diameter of the fiber filler being 1 through 10 μm, and an average length of the fibers being 20 through 100 μm, and the diameter of the particulate filler being 10 through 50 μm, thereby obtaining a porous layer which in use is hard to clog and is high in durability.

2 Claims, 2 Drawing Sheets

POROUS LAYER FOR A PRESSURE CASTING MOLD

FIELD OF THE INVENTION

The present invention relates to the construction of a porous layer in a pressure casting mold which in operation supplies slurry into a molded open space formed by porous layers and applies pressure to the slurry so as to quickly deposit the slurry onto the surface of the porous layer.

PRIOR ART

A pressure casting method for applying pressure to slurry so as to reduce a molding cycle has recently been popularized as means for molding an article, such as a toilet stool or a wash basin, of complicated configuration. The pressure casting method provides porous layers and back-up layers for reinforcing the porous layers in the form of vertically divided molds. A molded open space is formed between the porous layers of upper and lower mold units, slurry is injected into the molded open space and pressurized to discharge the water content in the slurry through the porous layers, and the slurry thus has a higher deposition speed. After a predetermined deposition of slurry is obtained, surplus slurry is discharged from the mold units. Back pressure is applied to the porous layers by the use of compressed air so that the water content stored in the porous layers is exuded to the interface between the mold unit surfaces and the deposited slurry formed of basic material to form a water film, thereby removing raw material from the interior surfaces of the mold units. Hence, the raw material slides easily on the interior surfaces so as to facilitate removal of raw material from the mold.

The porous layer onto which the slurry is deposited is usually molded of plaster. In the case of using plaster, however, the water content in the slurry is not smoothly discharged and it takes a large amount of time to complete one casting, thereby resulting in poor productivity. Moreover, with plaster clogging easily occurs thereby making the plaster mold defective and lessening the number of times of repeated use thereof.

Therefore, conventionally the porous layer molded of resin, the so-called resin mold, has been used, and the resin mold is formed mainly of resin material, a filler, a curing agent and water. The kneaded material of the above mixture is poured in the mold so that, when the material is semi-hardened, compressed air is supplied thereinto through water and air passage channels previously embedded, and the water content and an emulsifier are extruded from the kneaded material to form the porous material. After the porous layer thus is-formed, the porous layer is reinforced by a back-up layer so as to complete the pressure casting mold. Such resin mold, when in use, is hard to clog in comparison with the plaster mold so that the number of times of repeated use of the resin mold can be remarkably increased. Also, the same is characterized in that its molding cycle is short and its productivity is superior.

In the conventional resin mold, the filler of one of main components uses shellven, silica sand, quartz, glass powder or the like. These fillers all are polygonal like a ball, which, when the resin mold is produced, considers flowability of the kneaded material formed mainly of resin, filler, curing agent and water. In other words, when the kneaded material of resin is poured into the mold, if the flowability is not sufficient, it is impossible to obtain the resin mold, such as sanitary earthenware, complicated in configuration.

However, since all the fillers are ball-like polygonal, the porous material after being molded is simple in orientation, thereby having the disadvantage that its porosity is low. When compared with the plaster mold, the resin mold is harder to clog, but is simple in the arrangement of pores, thereby creating a fatal problem for this kind of pressure casting mold in that the clogged portion cannot at all discharge water and supply air.

In brief, for the porous resin mold, when the mold itself is made, its material is required to be superior in flowability. After being molded, when partially clogged, material higher in porosity and more complicated in orientation can cover the clogged portion by pores in the vicinity thereof, thereby functioning to make the mold hard to clog. However, the conventional resin mold has been unable to meet such requirement.

SUMMARY OF THE INVENTION

An object of the present invention is to provide a porous layer for a pressure casting mold which in making is easy to a mold, superior in porosity, and formed of pores complicated and hard to clog. In the pressure casting mold which uses material mainly of resin material, filler, curing agent and water to form porous layers A and has a back-up layer B at the rear surface of each porous layer A, the porous layer A comprises a filler which is formed of needle-like fibers and ball-like or substantially round particulates of glass material, the needle-like filler 1 being of average particle size or diameter of 1 through 10 μm and average length of 20 through 100 μm. The ball-like filler 2 is of particle size or diameter of 10 through 50 μm.

Accordingly, the material for molding the porous layer A of the present invention includes needle-like and ball-like fillers in mixture. In a case where the needle-like filler 1 and ball-like filler 2 are independently used, configuration and distribution and arrangement of pores thereof are simple, conversely, when the needle-like and ball-like fillers are used in mixture, both the fillers are mutually entangled so as to form pores complicated in configuration. Accordingly, it is possible when using the mixture to mold porous layer A which results in a layer which is superior in porosity and hard to clog. Moreover, since the ball-like filler 2 is used in the mixture, sufficient flow-ability in practical use can be ensured and the material is easy to pour into a mold when the resin mold is made.

DESCRIPTION OF THE PREFERRED EMBODIMENT

Figure 1:
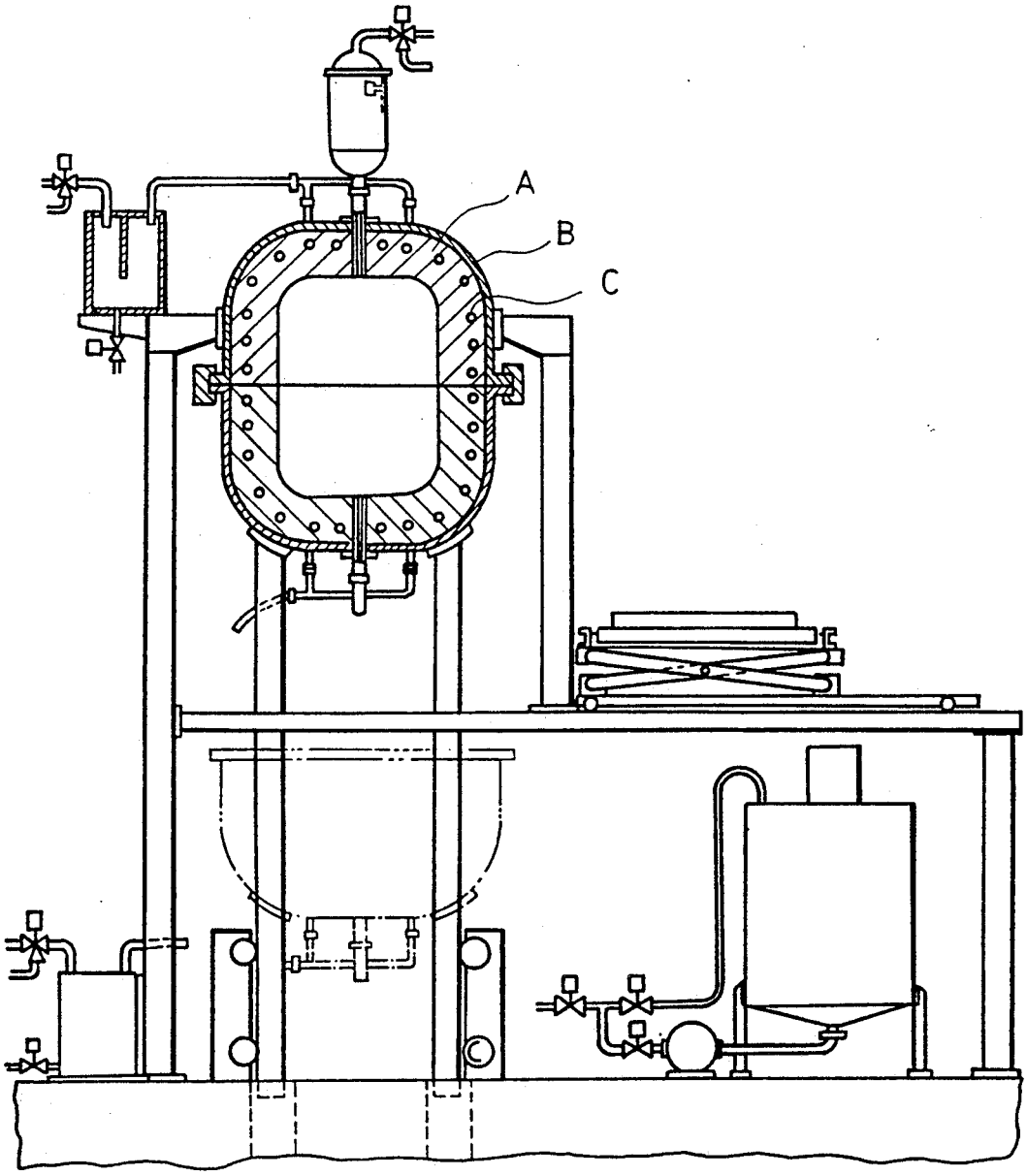
FIG. 1 PRIOR ART
FIG. 1 is a front view of a pressure casting apparatus as a whole.

As disclosed in the Japanese Patent Laid-Open Gazette No. Sho 58-208005 of the prior art a pressure casting mold is constructed as shown in FIG. 1. However, the porous layers A are improved in the present invention. A pressure casting mold of the present invention is formed of porous layers A and back-up layers B, the porous layers A each being composed mainly of resin material, a filler, a curing agent and water, the resin material being formed of epoxy, polyester, or acrylic. In this embodiment, needle-like fillers of glass fiber cut in the predetermined length and ball-like or round particulate glass material are used in mixture, the ratio between the needle-like filler 1 and the ball-like filler 2 being proper in a range of 4:1 through 1:1. The reason for this is that, when the ratio is smaller than 1:1, the effect of applying the needle-like filler 1 is little and the porous layer clogs easily, and, when exceeding 4:1, a directional property is made due to the configuration of the mold so that variation is created in air blowing during the removal of the basic material being molded from the mold. In addition, reference letter C designates drainages.

Figure 2:
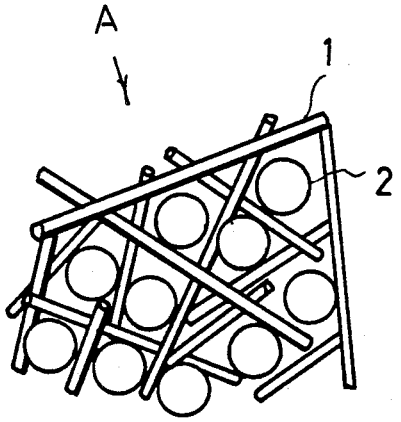
FIG. 2 is an enlarged view showing arrangement of needle-like fillers and ball-like fillers inside a porous layer A.

In forming the porous layer A, as shown in FIG. 2, pores thereof are formed in a gap between the fillers, whereby the size and configuration of the filler is an important factor. In this embodiment, a diameter of the needle-like or fiber filler is about 1 through 10 μm, because there are problems when the fiber diameter largely exceeds 10 μm, the flowability is lessened when the main components are kneaded and poured into the mold so smoothing is not obtained and the diameter of pore becomes too large so that the pores are not densely distributed through the entire layers. The pores, when densely distributed throughout the entire porous layer, serve to make the deposition speed of the slurry uniform throughout the entire layers A and air blow during the removal from the mold is promoted to facilitate removal of the entire basic material from the mold. On the other hand, when the diameter of the needle-like filler 1 is smaller than 1 μm, the forming the pores between the fillers is reduced.

The needle-like filler 1 should be 20 through 100 μm in average length. The reason for this is that configuration of the filler 1, when its length is smaller than 20 μm, becomes like a ball, which is the same as the conventional case where the ball-like fillers are independently used. When exceeding 100 μm, the viscosity, when the main component is kneaded, lowers to lessen the flowability.

In addition, the ball-like filler 2 is of about 10 through 50 μm in size or diameter.

Thus, the needle-like filler 1 set of its average diameter and length and the ball-like filler 2 in conventional use are mixed, so that when the main components are kneaded, the needle-like and ball-like fillers are mutually entangled to form pores complicated in configuration. Moreover, the entire porosity increases. Also, since the ball-like filler 2 is present, flowability is substantially sufficiently ensured in practical use.

In brief, the main components forming the porous layer A of the present invention, when kneaded and poured into a mold, provide that the flowability is sufficient in practical use. After being molded, a porous layer A is obtained which is complicated in configuration and superior in porosity. Therefore, in a case where the pressure casting mold is used as a slurry-casting-mold to mold sanitary earthenware, even when part of porous layer A is clogged, the water content is discharged and compressed air carries out back pressurization through the pores of the complicated configuration located in the vicinity of a clogged part, thereby enabling the clogged part to be covered, whereby minor clogging does not at all affect the casting mold. Hence, the number of times of repeated use of the casting mold is expected to remarkably increase.

The present invention is not limited to the above-mentioned embodiment, but may be applied to a pressure casting mold vertically dividable and to other dividable molds.

As seen from the above, in the present invention, the filler of material to mold the porous layer A uses the needle-like filler 1 and ball-like filler 2 in mixture, whereby both the fillers 1 and 2 are mutually entangled to form therebetween pores complicated in configuration, thereby obtaining the porous layer A superior in porosity and hard to clog. Therefore, the number of times the resin mold can be repeatedly used is remarkably improved. Moreover, the filler forming the porous layer A is mixed with the ball-like one to enable a sufficient flowability in practical use to be ensured. Hence, the material, when the resin mold is made, is easy to pour therein.

What is claimed is:

1. A mold used in pressure casting comprising:

a first mold unit and a second mold unit contacting each other and forming an inner open space, each of said mold units including an inner porous layer, drainage means located in each said inner porous layer, each said inner porous layer being made up of resin material, a curing agent and water, and a filler, and said filler being made up of fibers having an average diameter of 1 through 10 μm and an average length of 20 through 100 μm, and of particulates having a diameter of 10 through 50 μm, whereby said porous layer is hard to clog and is high in durability during use.

2. A mold in presence casting as recited in claim 1 wherein a back-up layer is disposed on an outside surface of each said porous layer.

* * * * *